US007293930B2

(12) United States Patent
Chuang

(10) Patent No.: US 7,293,930 B2
(45) Date of Patent: Nov. 13, 2007

(54) DISPENSER HEAD FOR FLUID CONTAINER

(76) Inventor: Kaiwin Chuang, 2095 S. Leo Ave., Commerce, CA (US) 90040

( * ) Notice: Subject to any disclaimer, the term of this patent is extended or adjusted under 35 U.S.C. 154(b) by 139 days.

(21) Appl. No.: 11/095,678

(22) Filed: Mar. 31, 2005

(65) Prior Publication Data

US 2006/0222445 A1 Oct. 5, 2006

(51) Int. Cl.
*B43K 7/10* (2006.01)
*B43K 5/14* (2006.01)

(52) U.S. Cl. ..... 401/216; 401/214; 401/134

(58) Field of Classification Search ..... 401/208–216, 401/132, 134, 198, 199
See application file for complete search history.

(56) References Cited

U.S. PATENT DOCUMENTS 2,823,403 A * 2/1958 Whitney ..... 401/213
2,976,561 A * 3/1961 Culver ..... 401/213
4,342,522 A * 8/1982 Mackles ..... 401/214
4,500,222 A * 2/1985 Clading-Boel ..... 401/209
4,723,860 A * 2/1988 Giblin et al. ..... 401/208
5,904,432 A * 5/1999 Ando et al. ..... 401/209
5,938,363 A * 8/1999 Timms et al. ..... 401/209

* cited by examiner

*Primary Examiner*—David J. Walczak
(74) *Attorney, Agent, or Firm*—Raymond Y. Chan; David and Raymond Patent Group

(57) ABSTRACT

A dispenser head for mounting to a container body has a storage cavity to contain a predetermined volume of agent, wherein the dispenser head comprises an inserting portion adapted for slidably inserting into the container body to communicate with the storage cavity, and a head housing defining a dispensing opening extended from the inserting portion. A ball dispenser is rotatably disposed at the head housing, and a retention seat is provided at the head housing to substantially retain the ball dispenser at a position wherein the ball dispenser is rotatably received in the head housing for contacting with the agent and a portion of the ball dispenser is exposed from the head housing, so that the spherical applying surface of the ball dispenser is adapted for evenly contacting with the agent to be applied to user.

13 Claims, 4 Drawing Sheets

DISPENSER HEAD FOR FLUID CONTAINER

BACKGROUND OF THE PRESENT INVENTION

1. Field of Invention

The present invention relates to a dispenser device, and more particularly, relates to a rotatable dispenser head of a fluid container, wherein the rotatable dispenser is adapted to directly contact with lips of user for smoothly guide out fluid from the container.

2. Description of Related Arts

Lipstick is one of the essential daily skin care products for most people. For most customers, a lipstick is used as a thin coating film on the lips for skin protection, especially in dry weather or in low humidity environments. A conventional lipstick comprises a column shaped container, and a cap provided at one end of the container, by twisting off the cap, a user is able to open the cap. Furthermore, a rotatable tuner is provided to the other end of the container, so that user can shift-in or shift-out an inner piston received in the container by reciprocally rotating the tuner. Commonly, the piston is padded with wax-type or pasty lipstick lubricant, so that a user could apply the lubricant piston onto the lips.

However, there are considerable disadvantages of such conventional lipsticks. First of all, such lipsticks waste too much material. Secondly, such lipsticks could not either be refilled or recycled. And more importantly, such wax-type or pasty lipsticks are less efficient. This is due to the fact that padding material of lipstick could not be completely consumed. It is inevitable that a quantity of unconsumed lipstick materials would be remained inside the container.

To solve such inefficient problems, some kind of liquid lipsticks have been introduced into the cosmetic market. Commonly, a liquid lipstick comprises a container housing for carrying liquid or pasty lipstick material, a dispensing mouth provided to one end of the container housing, and a piston is slidably received in the container housing for forcing the liquid material oozing out from the container housing via the dispensing mouth. Furthermore, a shank is attached to the piston for moving the piston shift within the housing so as to force the lipstick material flow out.

What is more, to smoothly flow out liquid material, a plate is attached to the dispensing mouth, wherein the plate has at least one orifice formed thereon to allow the lipstick material flow out. For user's convenience, there is a dispensing member, such as a brush, extended from the dispensing mouth for user's application.

Unfortunately, the internal design of the above described lipstick dispenser is too complicated and it is hard for user to appropriately operate it. Furthermore, after an extended period of use, the dehydrated liquid would clog or sticky on the dispensing brash, thus worsening the dispensing functions. It is highly possible that liquid material would cause unwanted chemical reactions with those dispensing devices.

On the other hand, unlike traditional lipstick, which is made of wax of pasty material, user could tune out the piston and directly apply the lipstick to the lips. The liquid lipstick must rely on some sort of liquid dispensing devices, such as a tiny brush, a pin-pointed orifice, to lubricate or moisten the lips. Therefore, user would feel uncomfortable or uneasiness when such kind of dispensing devices being directly contacted to the lips, which are the most sensitive organ of human body.

SUMMARY OF THE PRESENT INVENTION

A primary object of the present invention is to provide a dispenser head for a liquid lipstick, wherein the dispenser head is capable smoothly guiding out the liquid agents from the container.

Another object of the present invention is to provide a dispenser head for a liquid lipstick, wherein no complicated structure or expensive device are applied, therefore, the costs of manufacturing such liquid lipstick could be dramatically decreased.

Another object of the present invention is to provide a dispenser head for a liquid lipstick, wherein the dispenser head is made of stainless steel, so as to avoid any unwanted chemical reaction.

Another object of the present invention is to provide a dispenser head for a liquid lipstick, wherein no plates or orifices are required to provide at one end of the liquid container, therefore, there is no possibility that the dehydrated liquid stuff would be sticky on the dispenser body to cause any undesirable contact.

Accordingly, to achieve above mentioned objects, the present invention provides a dispenser head for mounting to a container body having a storage cavity to contain a predetermined volume of agent, wherein the dispenser head comprises:

a hollow head body having an inserting portion adapted for slidably inserting into the container body to communicate with the storage cavity, and a head housing defining a dispensing opening extended from the inserting portion;

a ball dispenser, having an outer spherical applying surface, rotatably disposed at the head housing; and a retention seat comprising a plurality of retention arms radially extended from an inner wall of the head housing to substantially retain the ball dispenser at a position that a portion of the ball dispenser is received in the head housing for contacting with said agent in the storage cavity and a portion of the ball dispenser is exposed out of the dispensing opening, such that when the ball dispenser is freely rotated at the dispensing opening, the spherical applying surface of the ball dispenser is adapted for evenly contacting with the agent.

These and other objectives, features, and advantages of the present invention will become apparent from the following detailed description, the accompanying drawings, and the appended claims.

DETAILED DESCRIPTION OF THE PREFERRED EMBODIMENT

Figure 1:
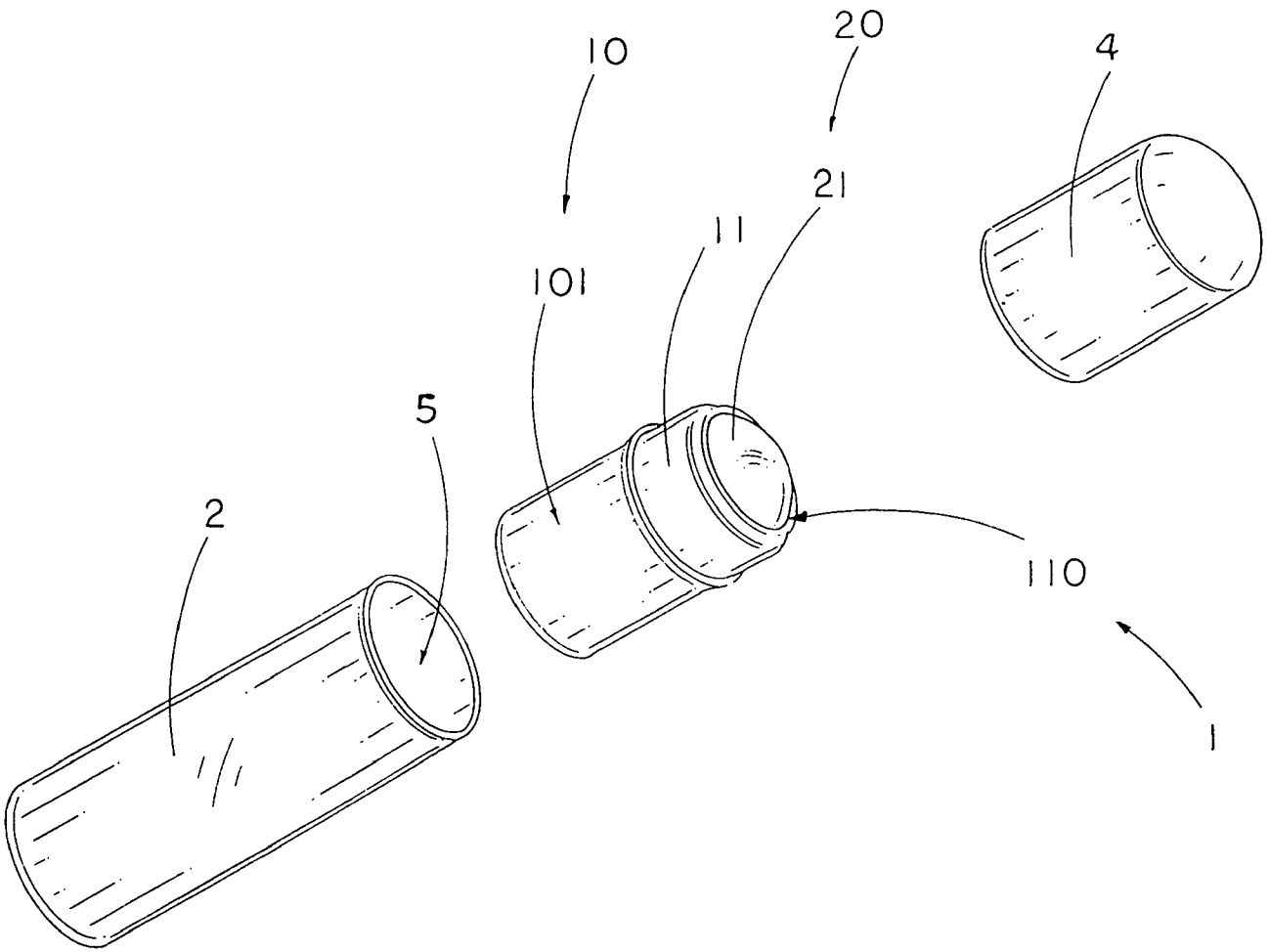
FIG. 1 is an exploded perspective view of a dispensing unit according to the preferred embodiment of the present invention.

Referring to FIG. 1, a dispensing unit according to the preferred embodiment of the present invention is illustrated. The dispensing unit comprises a dispenser head 1 for mounting to a container body 2 having a storage cavity 5 to contain a predetermined volume of agent 3. The dispenser head 1 comprises a hollow head body 10 having an inserting portion 101 adapted for slidably inserting into the container body 2 to communicate with the storage cavity 5, and a head housing 11 defining a dispensing opening 110 extended from the inserting portion 101.

Figure 2:
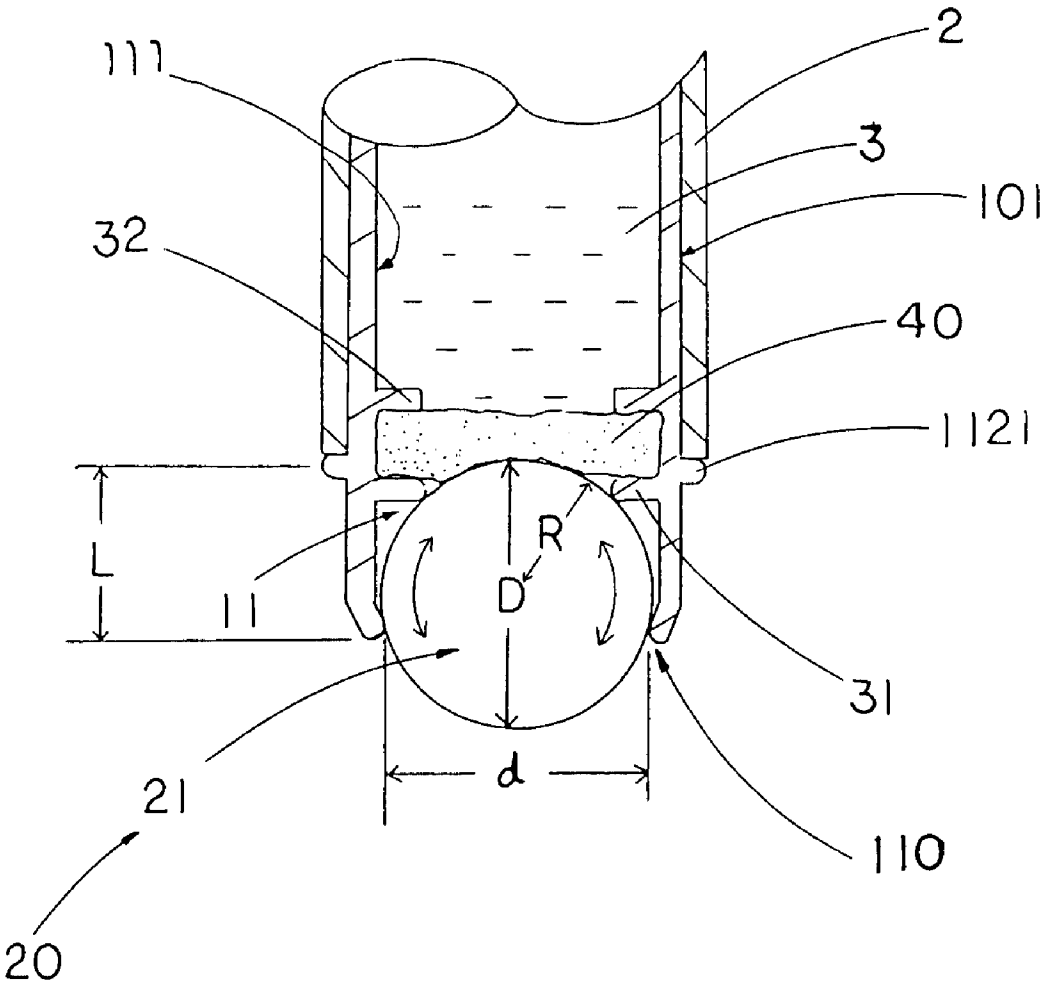
FIG. 2 is a sectional view of the dispenser head according to the above preferred embodiment of the present invention.

The dispenser head 1 further comprises a ball dispenser 20, having an outer spherical applying surface 21, rotatably disposed at the head housing 11, and a retention seat 30 comprising a plurality of retention arms 31 radially extended from an inner wall 111 of the head housing 11 to substantially retain the ball dispenser 20 at a position that a portion of the ball dispenser 20 is received in the head housing 11 for contacting with the agent 3 in the storage cavity 5 and a portion of the ball dispenser 20 is exposed out of the dispensing opening 110, such that when the ball dispenser 20 is freely rotated at the dispensing opening 110, the spherical applying surface 21 of the ball dispenser 20 is adapted for evenly contacting with the agent 3. As shown in FIG. 2, the retention seat 30 is adapted to divide the hollow head body 10 into two cavities, namely, the inserting portion 101 and the head housing 11.

According to the preferred embodiment of the present invention, the dispenser head 1 further comprises an absorbing pad 40 substantially disposed in the head body 10 for absorbing the agent 3, wherein the ball dispenser 20 rotatably received in the head housing 11 is substantially contacted with the absorbing pad 40 for ensuring the agent 3 evenly applying on the spherical applying surface 21 of the ball dispenser 20 when the ball dispenser 20 is rotated.

The retention seat 30 further comprises a plurality of holding arms 32 radially extended from the inner wall 111 of the head housing 11 to securely hold the absorbing pad 40 at a position that the absorbing pad 40 is substantially contacted with a corresponding portion of the ball dispenser 20. Preferably, the absorbing pad 40 is a foam pad disposed within the retention seat 30, so that the agent 3 could be soaked by the foam pad to be contacted with the ball dispenser 20.

It is noted that the agent 3 could be liquid agent, lip treatment agent, gel, pasty material, solid-state agent, adhesive agent and so on. In case of the solid-state agent is employed in applications, the absorbing pad 40 of the preferred embodiment of the present invention could be removed for facilitating the application.

In other words, the absorbing pad 40 is received within the retention seat 30 for isolating the head housing 11 from the remaining head body 10, wherein the ball dispenser 20 is rotatably contacted with one side of the absorbing pad 40 and the agent 3 is supposedly contacting with the other side of the absorbing pad 40. As a result, the agent could be seeped into the absorbing pad for soaking the ball dispenser 20.

Preferably, the ball dispenser 20 is made of stainless steel or other materials having a firm rigidity. This is due to the fact that when such ball dispenser 20 is applied to user's lips, the stainless steel ball dispenser 20 could smooth out the friction between the dispenser and the lips. Moreover, the stainless steel ball, having a relatively higher density and rigidity, is adapted for preventing any dehydrated agent 3 remain or clog on the surface of the head dispenser 20. That is to say, it is unlikely that the stainless steel ball dispenser 20 would form some pores on its spherical surface, so that the likelihood of any undesirable chemical reaction between the remained or clogged agent 3 and head dispenser 20 would be dramatically minimized.

Figure 3:
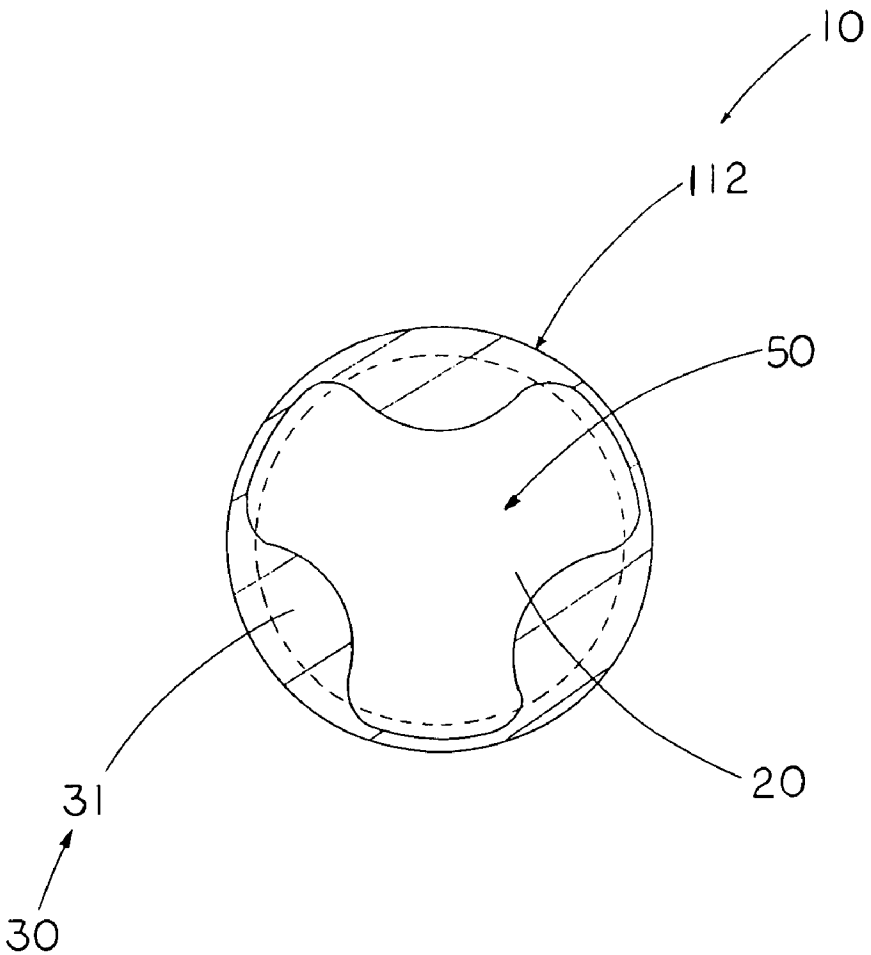
FIG. 3 is a top view illustrating the retention seat according to above preferred embodiment of the present invention.

As shown in FIG. 2 and FIG. 3, the absorbing pad 40 is not only tightly attached onto the retention seat 30 for isolating the head housing 11 from the head body 10, but is integrally and inwardly projected from the inner wall 111 of the head body 10.

The retention arms 31 are radially extended from the inner wall 111 of the head housing 11 to substantially contact with the spherical applying surface 21 of the ball dispenser 20 within the head housing 11 so as to block a lateral movement of the ball dispenser 20 with respect to the head housing 11, wherein a guiding channel 50 is formed within the head housing 11 between a gap of the retention arms 31 for allowing the agent 3 to apply on the spherical applying surface 21 of the ball dispenser 20.

As shown in FIG. 3, the retention seat 30 comprises a circular shoulder integrally and inwardly projected from the inner wall 111 of the head housing 11 wherein the retention arms 31 are radially and spacedly extended from the circular shoulder for blocking the ball dispenser 20 from being laterally moved along the head body 10. What is more, at least three retention arms 31 are spacedly and radially extended from the inner wall 111 for snugly propping up the ball dispenser 20. Therefore, the guiding channel 50 is correspondingly defined by the numbers of the retention arms 31.

Here, according to the preferred embodiment of the present invention, the diameter "d" of the dispensing opening 110 is substantially smaller than a diameter "D" of the ball dispenser 20 so as to securely hold the ball dispenser 20 at the head housing 11 in a rotatably movable manner.

The ball dispenser 20 is rotatably received within the head housing 11. In the preferred embodiment, the head housing 11 has a predetermined size for enabling a portion of the ball dispenser exposed for application purpose. That is to say, the length "L" of the head housing 11 is set with a size being shorter than a diameter "D" of the ball dispenser 20 and longer than a radius "R" of the ball dispenser 20. Preferably, the length "L" of the head housing 11 is two third of the ball dispenser 20 for guaranteeing a substantial portion of the ball dispenser 20 exposed for a smooth application. Moreover, as shown in FIG. 3, the circular edge of the head housing 11 is inwardly curved so as to guarantee the diameter "d" of the dispensing opening 110 is smaller than the diameter "D" of the ball dispenser 20. As a result, the ball dispenser 20 could be fittingly and proportionally surrounded and wrapped by the head housing 11.

The head body 10 further comprises an outer wall 112, wherein a dividing ridge 1121 is circumferentially defined on the outer wall 112 for separating the inserting portion 101 from the head housing 11. Here, the inserting portion 101 sized and shaped correspondingly mating the storage cavity 5, so that the inserting portion 101 of the head body 10 could be slidably and tightly inserted into the container body 2.

Furthermore, the dispensing unit 1 comprises a head cap 4 for sealedly enclosing the head dispenser 20. Preferably, the inner wall of the head cap 4 and the outer surface of the head housing 11 are threadedly defined and correspondingly mated so that the head housing 11 could be screwed into the head cap 4.

Conclusively, the present invention provides a dispensing unit comprising a container body 2 refillably reserving a predetermined volume of the agent 3, a dispenser head 20, detachably mounted to the container body 2, wherein the dispenser head comprises a hollow head body 10, having an inserting portion 101 slidably inserting into the container body 2 to communicate with the storage cavity 5, and a head housing 11 defining a dispensing opening 110 extended from the inserting portion 101. A ball dispenser 20, having an outer spherical applying surface 201, is rotatably disposed at the head housing 11. The dispenser head further comprises a retention seat 30 comprising a plurality of retention arms 31 radially extended from an inner wall 111 of the head housing 11 to substantially retain the ball dispenser 20 at a position that a portion of the ball dispenser 20 is received in the head housing 11 for contacting with the agent 3 in the storage cavity 5 and a portion of the ball dispenser 20 is exposed out of the dispensing opening 110, such that when the ball dispenser 20 is freely rotated at the dispensing opening 110, the spherical applying surface 21 of the ball dispenser 20 is adapted for evenly contacting with the agent 3.

Figure 4:
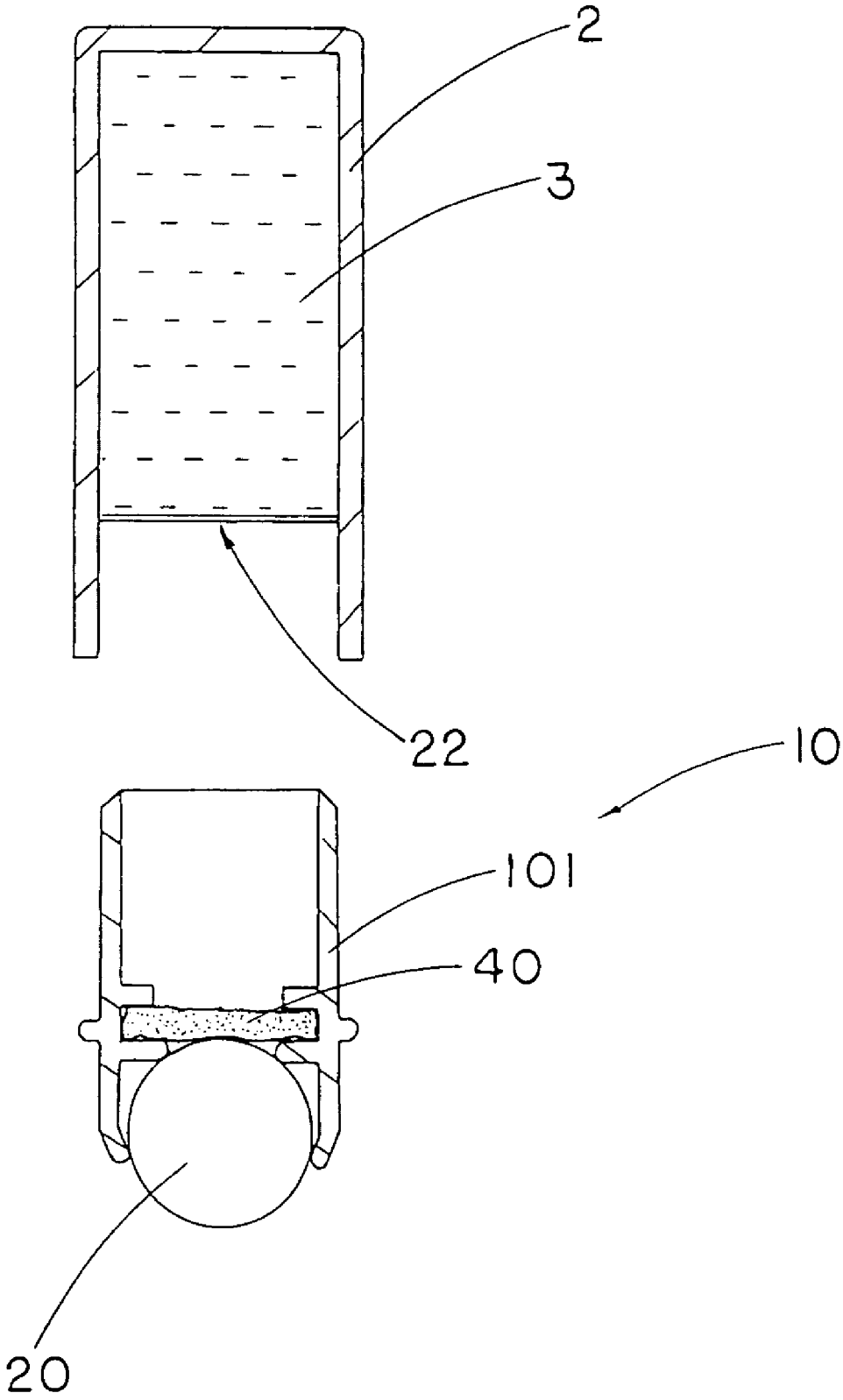
FIG. 4 is a sectional view of the container body showing a sealing layer sealedly enclosed within the container body for reservation according to the preferred embodiment of the present invention.

What is more, as shown in FIG. 4, the container body 2 has a sealing layer 22 sealedly enclosed the agent 3 in the storage cavity 5 and arranged in such a manner that when the inserting portion 101 body is slidably inserted into the container body 2, the sealing layer 22 is unsealed for allowing the agent 3 applying on the spherical applying surface 21 of the ball dispenser 20. Here, the sealing layer 22 is a layer of plastic film extruded into the storage cavity 20 for sealedly enclosing the agent 3 within the container body, so that when a foreign force is provided to insert the head body 10 into the container body 2, the plastic film is susceptible to be pricked up permitting the agent 3 flowing out.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A dispenser head for mounting to a container body having a storage cavity to contain a predetermined volume of agent, wherein said dispenser head comprises;

a hollow head body having an inserting body adapted for slidably inserting into said container body to communicate with said storage cavity, and a head housing defining a dispensing opening extended from said inserting body;

an absorbing pad disposed in said head body for contacting with said agent at one side and absorbing said agent within said absorbing pad;

a ball dispenser, having an outer spherical applying surface, disposed at said head housing in a free rotation manner at a position that a first portion of said spherical applying surface of said ball dispenser directly contacts with an opposed side of said absorbing pad for said agent applying on said spherical applying surface while a second portion of said spherical applying surface of said ball dispenser is exposed out of said dispensing opening, wherein said ball dispenser is freely rotated at said head housing for said agent evenly applying on said spherical applying surface of said ball dispenser; and a plurality of retention arms radially extended from an inner wall of said head housing to contact with said spherical applying surface of said ball dispenser, wherein said retention arms not only retains said ball dispenser at said head housing in a free rotation manner but also holds said absorbing pad in position to ensure said first portion of said spherical applying surface of said ball dispenser being directly contacted with said absorbing pad, wherein a guiding channel is formed within said head housing between a gap of every two said retention arms such that said spherical applying surface of said ball dispenser further contacts with said absorbing agent through said guiding channels.

2. The dispenser head, as recited in claim 1, further comprising a plurality of holding arms radially extended from said inner wall of said head housing to securely retain said absorbing pad at a position that said absorbing pad is substantially held between said retention arms and said holding arms to directly contact with said first portion of said spherical applying surface of said ball dispenser.

3. The dispenser head, as recited in claim 2, wherein said ball dispenser is made of stainless steel for minimizing a chemical reaction between said agent and said spherical applying surface of said ball dispenser and for resisting said agent from being evaporated.

4. The dispenser head, as recited in claim 3, wherein a diameter of said dispensing opening is substantially smaller than a diameter of said ball dispenser so as to securely hold said ball dispenser at said head housing in a rotatably movable manner, wherein a height of said head housing is smaller than said diameter of said ball dispenser.

5. The dispenser head, as recited in claim 2, wherein a diameter of said dispensing opening is substantially smaller than a diameter of said ball dispenser so as to securely hold said ball dispenser at said head housing in a rotatably movable manner, wherein a height of said head housing is smaller than said diameter of said ball dispenser.

6. The dispenser head, as recited in claim 1, wherein said ball dispenser is made of stainless steel for minimizing a chemical reaction between said agent and said spherical applying surface of said ball dispenser and for resisting said agent from being evaporated.

7. A dispensing unit, comprising:

a container body having a storage cavity and an agent containing therein and a dispenser head, which is detachably coupling with said container body, comprising:

a hollow head body having an inserting body slidably inserting into said container body to communicate with said storage cavity, and a head housing defining a dispensing opening extended from said inserting body;

an absorbing pad disposed in said head body contacting with said agent at one side and absorbing said agent within said absorbing pad;

a ball dispenser, having an outer spherical applying surface, disposed at said head housing in a free rotation manner at a position that a first portion of said spherical applying surface of said ball dispenser directly contacts with an opposed side of said absorbing pad for said agent applying on said spherical applying surface while a second portion of said spherical applying surface of said ball dispenser is exposed out of said dispensing opening, wherein when said ball dispenser is freely rotated at said head housing, said agent is evenly applied on said spherical applying surface of said ball dispenser; and a plurality of retention arms radially extended from an inner wall of said head housing to contact with said spherical applying surface of said ball dispenser, wherein said retention arms not only retains said ball dispenser at said head housing in a free rotation manner but also holds said absorbing pad in position to ensure said first portion of said spherical applying surface of said ball dispenser being directly contacted with said absorbing pad, wherein a guiding channel is formed within said head housing between a gap of every two said retention arms such that said spherical applying surface of said ball dispenser further contacts with said absorbing agent through said guiding channels.

8. The dispensing unit, as recited in claim 7, wherein said agent is lip treatment agent being stored in said storage cavity and being absorbed by said absorbing pad to apply on said spherical applying surface of said ball dispenser, wherein said container body has a sealing layer sealedly enclosed said agent in said storage cavity and arranged in such a manner that when said inserting body is slidably inserted into said container body, said sealing layer is unsealed for allowing said agent applying on said spherical applying surface of said ball dispenser through said absorbing pad.

9. The dispensing unit, as recited in claim 8, further comprising a plurality of holding arms radially extended from said inner wall of said head housing to securely retain said absorbing pad at a position that said absorbing pad is substantially held between said retention arms and said holding arms to directly contact with said first portion of said spherical applying surface of said ball dispenser.

10. The dispensing unit, as recited in claim 9, wherein said ball dispenser is made of stainless steel for minimizing a chemical reaction between said agent and said spherical applying surface of said ball dispenser and for resisting said agent from being evaporated.

11. The dispensing unit, as recited in claim 10, wherein a diameter of said dispensing opening is substantially smaller than a diameter of said ball dispenser so as to securely hold said ball dispenser at said head housing in a rotatably movable manner, wherein a height of said head housing is smaller than said diameter of said ball dispenser.

12. The dispensing unit as recited in claim 9, wherein a diameter of said dispensing opening is substantially smaller than a diameter of said ball dispenser so as to securely hold said ball dispenser at said head housing in a rotatably movable manner, wherein a height of said head housing is smaller than said diameter of said ball dispenser.

13. The dispensing unit, as recited in claim 7, further comprising a plurality of holding arms radially extended from said inner wall of said head housing to securely retain said absorbing pad at a position that said absorbing pad is substantially held between said retention arms and said holding arms to directly contact with said first portion of said spherical applying surface of said ball dispenser.

* * * * *